US010471623B2

(12) United States Patent
Adams et al.

(10) Patent No.: US 10,471,623 B2
(45) Date of Patent: Nov. 12, 2019

(54) WATERJET CUTTING SYSTEM WITH VARIABLE LIQUID LEVEL

(71) Applicant: Zuluboy, Inc., Tallmadge, OH (US)

(72) Inventors: Benjamin J. Adams, Cuyahoga Falls, OH (US); Jonathan Adams, Munroe Falls, OH (US)

(73) Assignee: HMCC ACQUIRECO2, LLC, Burlington, Ontario (CA)

( * ) Notice: Subject to any disclaimer, the term of this patent is extended or adjusted under 35 U.S.C. 154(b) by 279 days.

(21) Appl. No.: 15/296,801

(22) Filed: Oct. 18, 2016

(65) Prior Publication Data

US 2018/0104843 A1 Apr. 19, 2018

(51) Int. Cl.

| | |
|---|---|
| ***B26F 3/00*** | (2006.01) |
| ***B24C 7/00*** | (2006.01) |
| ***B26D 5/00*** | (2006.01) |

(52) U.S. Cl.

CPC ..... *B26F 3/004* (2013.01); *B24C 7/00* (2013.01); *B26D 5/00* (2013.01)

(58) Field of Classification Search

CPC .... B24C 3/22; B24C 3/04; B24C 7/00; B24C 9/00; B24C 9/006; B26F 3/004

See application file for complete search history.

(56) References Cited

U.S. PATENT DOCUMENTS

| | | | | |
|---|---|---|---|---|
| 3,351,113 | A * | 11/1967 | Suzuki | A23N 4/18 83/177 |
| 4,382,170 | A | 5/1983 | Klingel | |
| 5,056,718 | A | 10/1991 | Wakefield | |
| 5,120,930 | A | 1/1992 | Sanders et al. | |
| 8,176,819 | B2 | 5/2012 | Rydh | |
| 9,272,437 | B2 | 3/2016 | Hashish et al. | |

(Continued)

FOREIGN PATENT DOCUMENTS

| | | | |
|---|---|---|---|
| CN | 205835058 | U | 12/2016 |
| DE | 4313347 | A1 | 4/1993 |

(Continued)

OTHER PUBLICATIONS

Technical Possibilities of Noise Reduction in Material Cutting by Abrasive Water-jet, Agata Radvanska, et al., Strojarstvo 51, pp. 347-354 (2009).

(Continued)

*Primary Examiner* — Timothy V Eley
(74) *Attorney, Agent, or Firm* — BakerHostetler

(57) ABSTRACT

A waterjet system comprising a nozzle supported within a cutting tank, the cutting tank having a floor and at least one upstanding wall defining a cutting volume, wherein the cutting volume is at least partially filled with a liquid, and wherein the nozzle is submersible within the liquid to perform a submerged cutting operation; a high pressure fluid supply selectively fluidly connected to the nozzle to produce a cutting stream; a controller; a level sensor in sensing communication with the liquid in the cutting tank to measure a liquid height within the cutting tank, the level sensor being in communication with the controller to provide the liquid height to the controller; a liquid level assembly in communication with the controller and adapted to maintain a selected liquid level within the cutting tank.

18 Claims, 9 Drawing Sheets

(56) References Cited

U.S. PATENT DOCUMENTS

| | | | | |
|---|---|---|---|---|
| 2002/0173238 | A1* | 11/2002 | Kordonski | B24B 13/0025 451/36 |
| 2005/0095955 | A1* | 5/2005 | Mitsuishi | B24C 1/04 451/5 |
| 2007/0037495 | A1* | 2/2007 | Matsubara | B24C 1/045 451/75 |
| 2015/0118942 | A1* | 4/2015 | Hashish | B24C 3/06 451/80 |
| 2015/0196989 | A1 | 7/2015 | Hashish et al. | |

FOREIGN PATENT DOCUMENTS

| | | | |
|---|---|---|---|
| JP | H04105900 | A | 4/1992 |
| JP | H04372399 | A | 12/1992 |
| JP | H0578472 | U | 10/1993 |
| JP | H0724736 | A | 1/1995 |
| JP | H07328857 | A | 12/1995 |
| JP | 2008023502 | A | 2/2008 |
| JP | 2009233784 | A | 10/2009 |

OTHER PUBLICATIONS

Plasma Cutting—The History of Plasma Cutting, AZO Materials, sponsored by Hypertherm, Inc., Nov. 21, 2001.
Noise from High Pressure Water Jetting, Health & Safety Laboratory, Rebecca Hutt, HSL 2004/15.
Waterjet Cutting Systems, Innovation Through Passion, wwwtechniwaterjet.com.

* cited by examiner

WATERJET CUTTING SYSTEM WITH VARIABLE LIQUID LEVEL

BACKGROUND OF THE DISCLOSURE

1. Field of the Disclosure

This disclosure is directed to a waterjet cutting system. This disclosure is further directed to a waterjet cutting system that where the nozzle is at least partially submerged in liquid during at least a portion of the cutting process. The disclosure is further directed to a waterjet cutting system, where the level of the liquid within a cutting area may be varied.

SUMMARY OF THE DISCLOSURE

According to one aspect, a waterjet system is provided including a nozzle supported within a cutting tank, the cutting tank having a floor and at least one upstanding wall defining a cutting volume, wherein the cutting volume is at least partially filled with a liquid, and wherein the nozzle is submersible within the liquid to perform a submerged cutting operation; a high pressure fluid supply selectively fluidly connected to the nozzle to produce a cutting stream; a controller; a level sensor in sensing communication with the liquid in the cutting tank to measure a liquid level within the cutting tank, the level sensor being in communication with the controller to provide the liquid level to the controller; a liquid level assembly in communication with the controller and adapted to maintain a selected liquid level within the cutting tank.

Additional features, advantages, and aspects of the disclosure may be set forth or apparent from consideration of the following detailed description, drawings, and claims. Moreover, it is to be understood that both the foregoing summary of the disclosure and the following detailed description are exemplary and intended to provide further explanation without limiting the scope of the disclosure as claimed.

BRIEF DESCRIPTION OF THE DRAWINGS

The accompanying drawings, which are included to provide a further understanding of the disclosure, are incorporated in and constitute a part of this specification, illustrate aspects of the disclosure and together with the detailed description serve to explain the principles of the disclosure. No attempt is made to show structural details of the disclosure in more detail than may be necessary for a fundamental understanding of the disclosure and the various ways in which it may be practiced. In the drawings.

DETAILED DESCRIPTION OF THE DISCLOSURE

Figure 1:
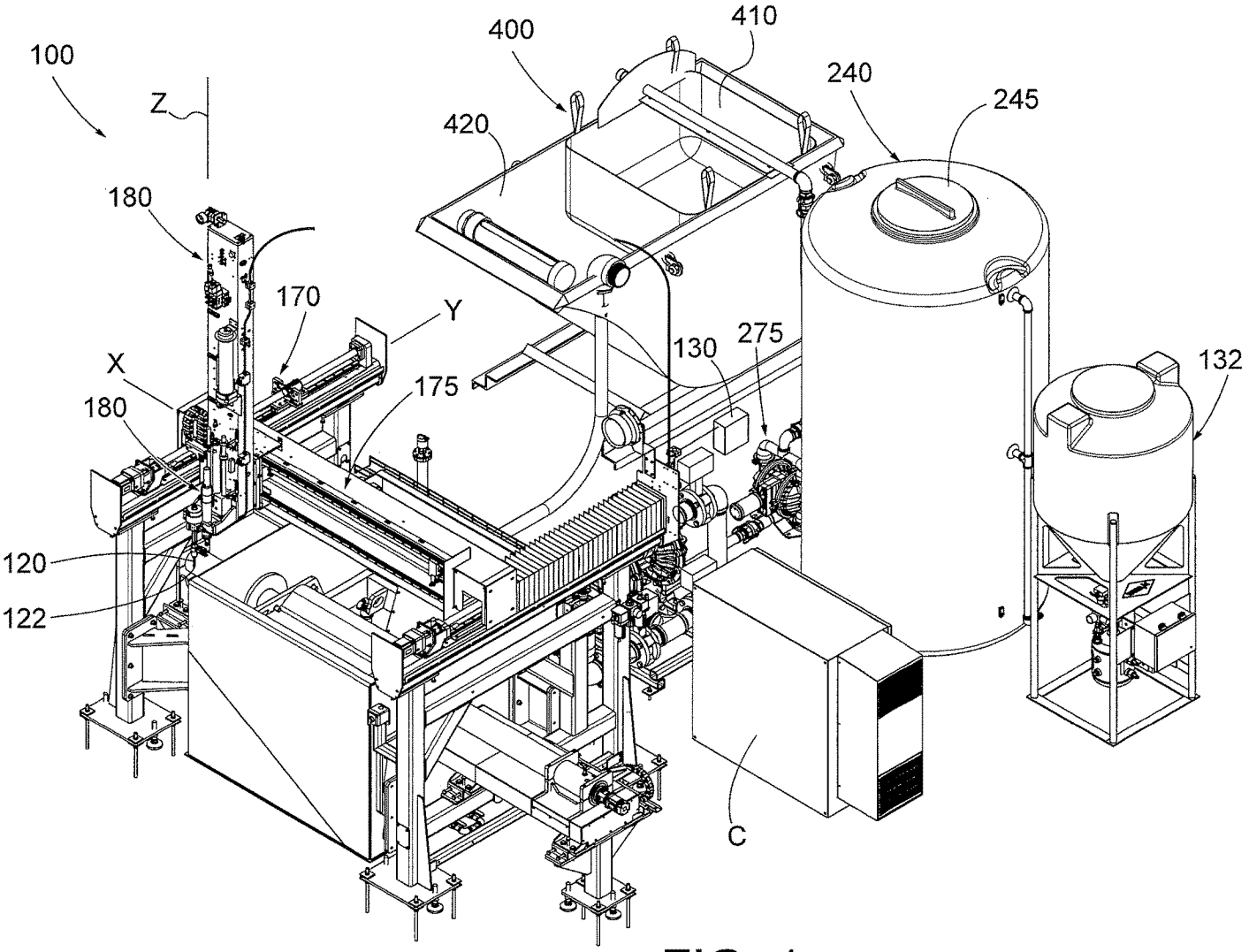
FIG. 1 is a perspective view of a waterjet system according to the principles of the disclosure.
Figure 2:
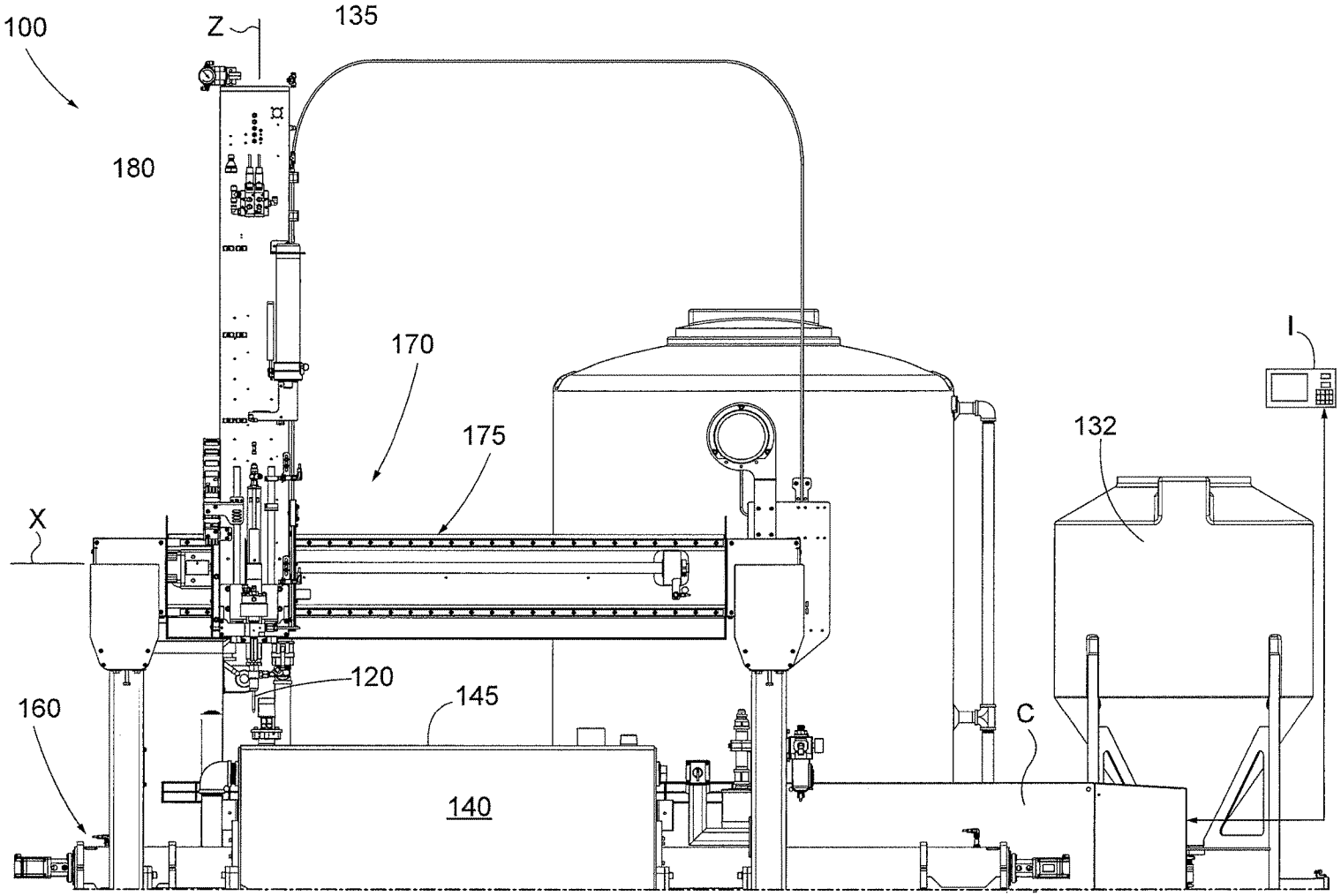
FIG. 2 is a front view thereof.
Figure 3:
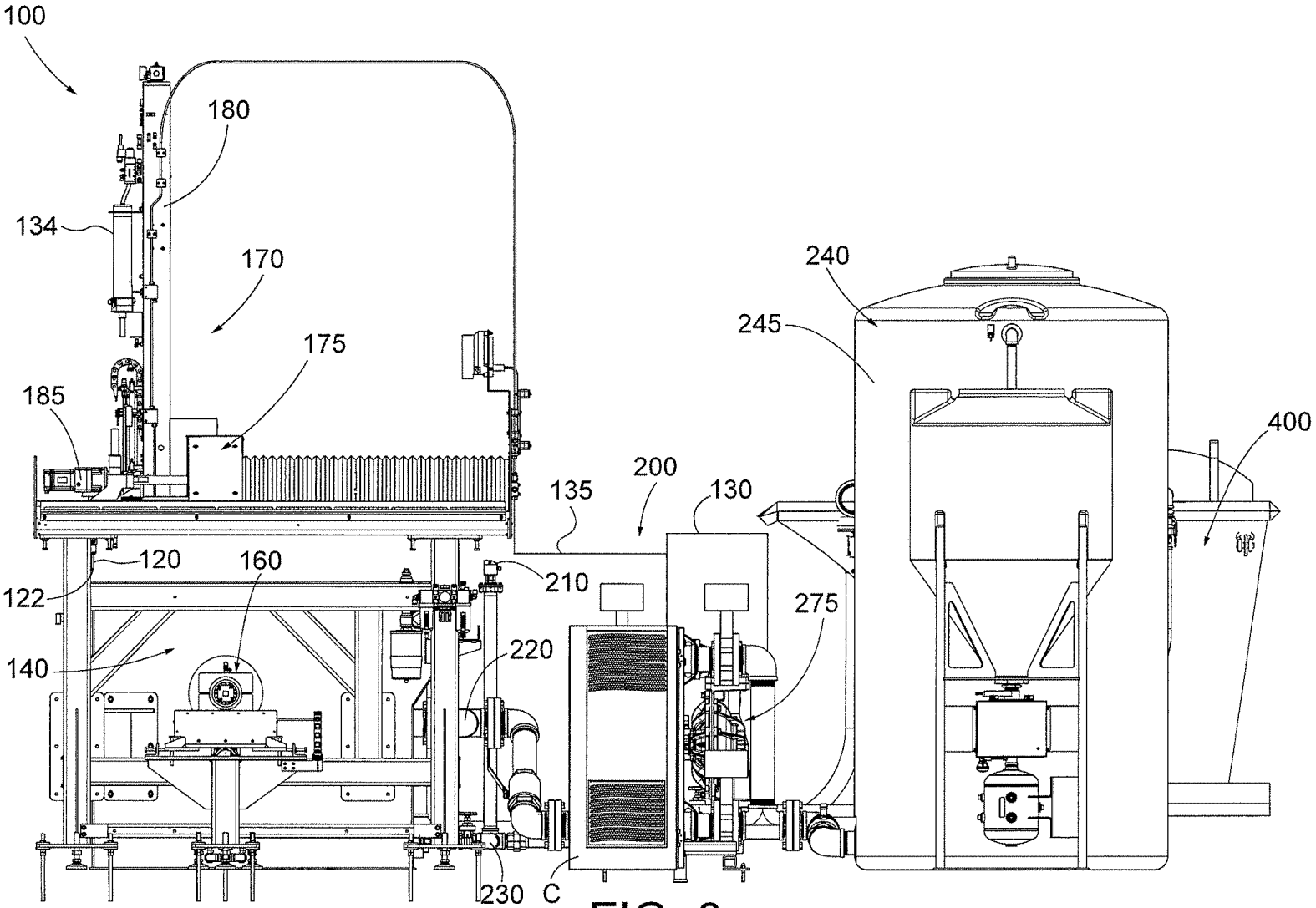
FIG. 3 is a right side view thereof.

The aspects of the disclosure and the various features and advantageous details thereof are explained more fully with reference to the non-limiting aspects and examples that are described and/or illustrated in the accompanying drawings and detailed in the following description. It should be noted that the features illustrated in the drawings are not necessarily drawn to scale, and features of one aspect may be employed with other aspects as the skilled artisan would recognize, even if not explicitly stated herein. Descriptions of well-known components and processing techniques may be omitted so as to not unnecessarily obscure the aspects of the disclosure. The examples used herein are intended merely to facilitate an understanding of ways in which the disclosure may be practiced and to further enable those of skill in the art to practice the aspects of the disclosure. Accordingly, the examples and aspects herein should not be construed as limiting the scope of the disclosure, which is defined solely by the appended claims and applicable law. Moreover, it is noted that like reference numerals represent similar parts throughout the several views of the drawings.

The disclosure is directed to a waterjet cutting system, which may be referred to as a waterjet system for brevity sake throughout this specification. The term waterjet is also not limiting in terms of the liquid used in the cutting process. Water is the most common liquid but other liquids may be used depending on the cutting application. The waterjet system described herein includes a nozzle or other tool that is submerged within a liquid during at least a portion of the cutting process. Submerging the nozzle may be required based on the material being cut or other considerations such as reducing the noise of the process or the mess created by the process by containing it within a fluid. For purposes of example, the liquid may be water, but other liquids may be used for specific applications. Similarly, although the system is described as a waterjet system, there may be instances where other fluids are used in the cutting process. Consequently, reference to water in the examples described herein should not be considered limiting.

With reference to FIG. 1, a waterjet system according to the invention is generally indicated by the number 100. Waterjet system generally includes cutting head 110 that supports a waterjet cutting tool, such as a nozzle 120. In general, the nozzle 120 delivers a high pressure stream of liquid to perform a cutting operation. Nozzle 120 includes a tip 122 at its outermost extremity. As shown, tip 122 may defining an outlet aligned with the axis of the nozzle 120 to direct the stream along the axis of the nozzle 120.

Figure 4:
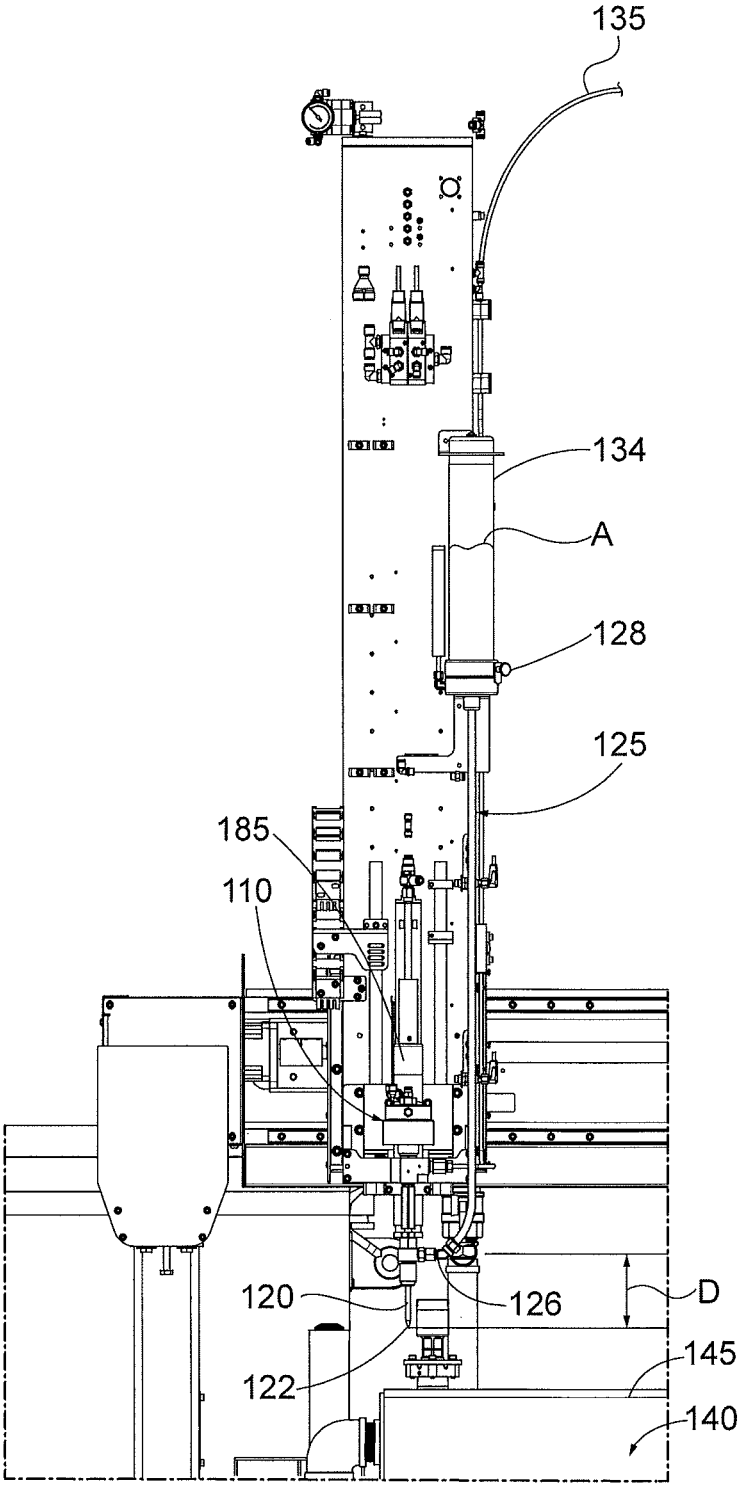
FIG. 4 is an enlarged view of a tool carriage within a waterjet system according to the principles of the disclosure.
Figure 5:
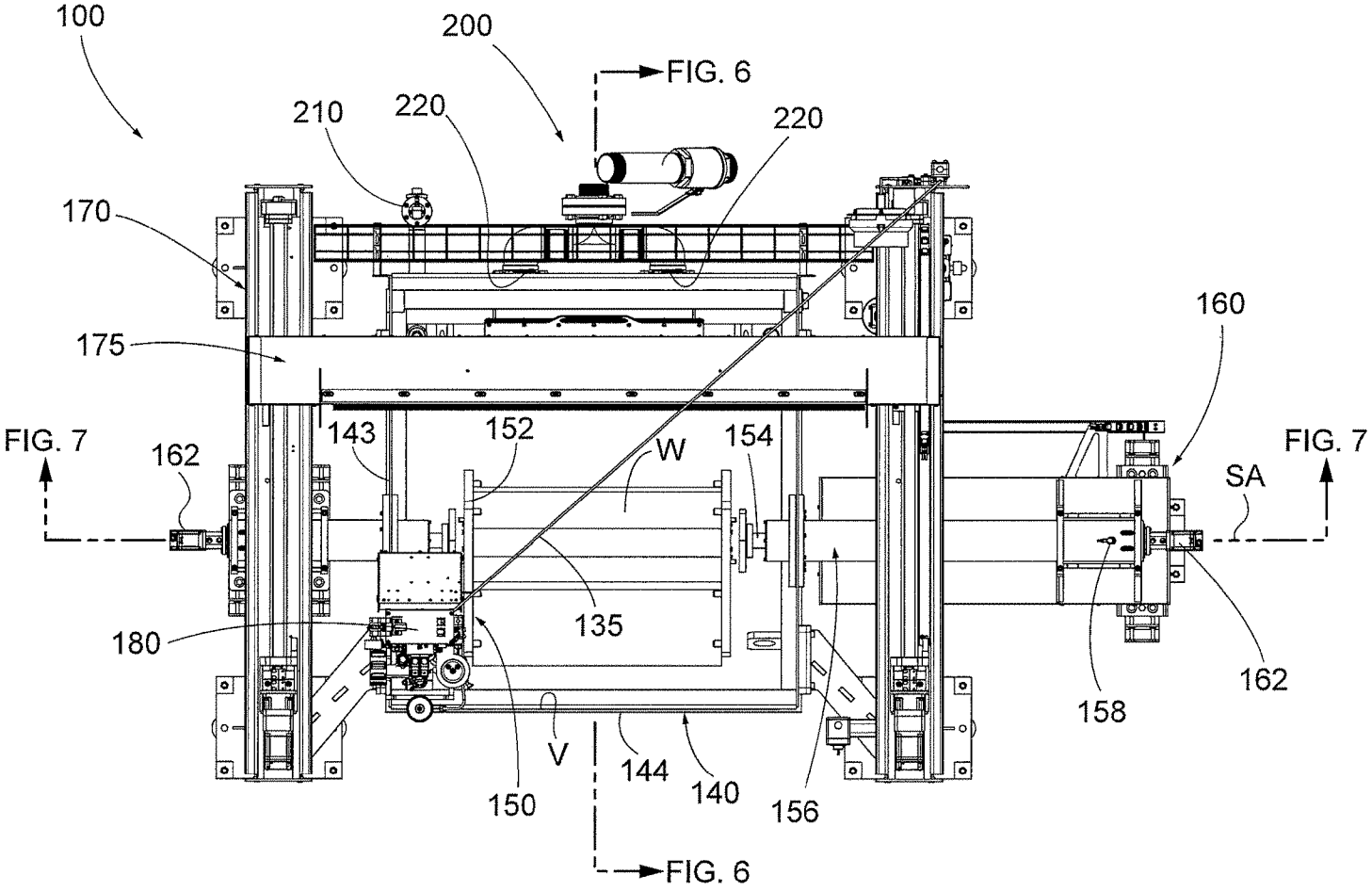
FIG. 5 is a top view of a waterjet system according to principles of the disclosure.
Figure 6:
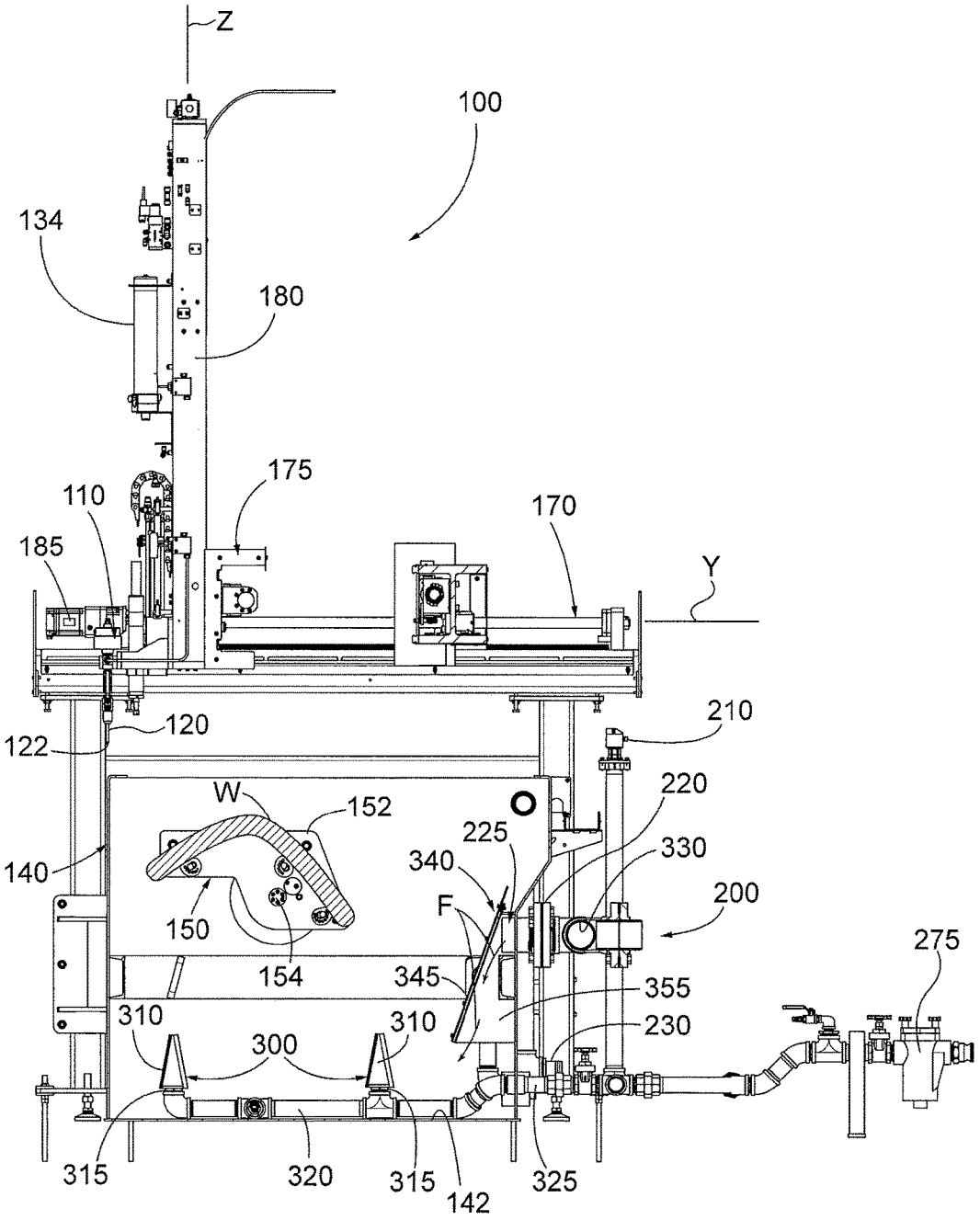
FIG. 6 is a partially sectioned view as might be seen along line 6-6 in FIG. 5 depicting further details of a waterjet system according to the principles of the disclosure.
Figure 7:
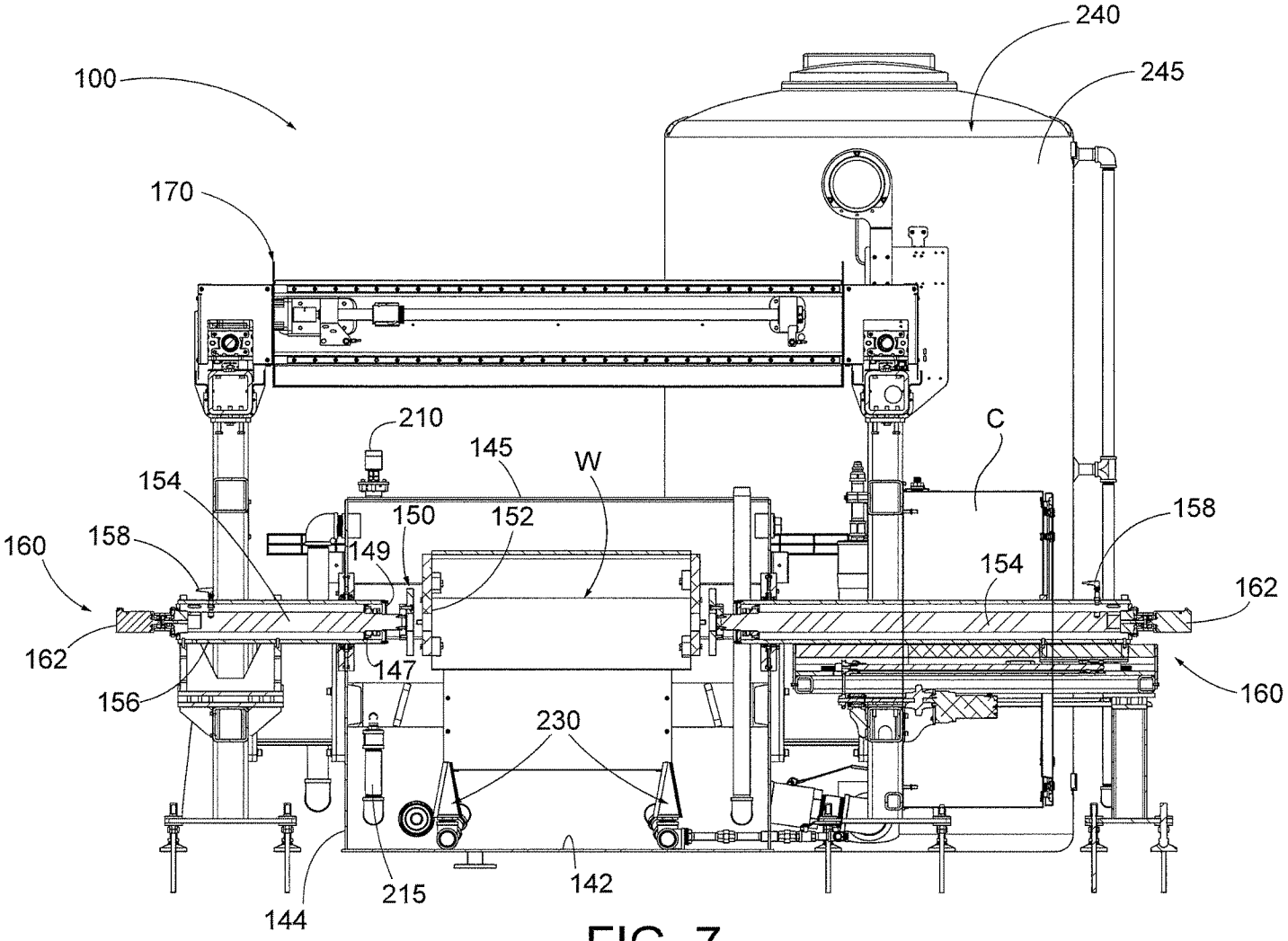
FIG. 7 is a partially sectioned view as might be seen along line 7-7 in FIG. 5 depicting further details of a waterjet system according to the principles of the disclosure.
Figure 10:
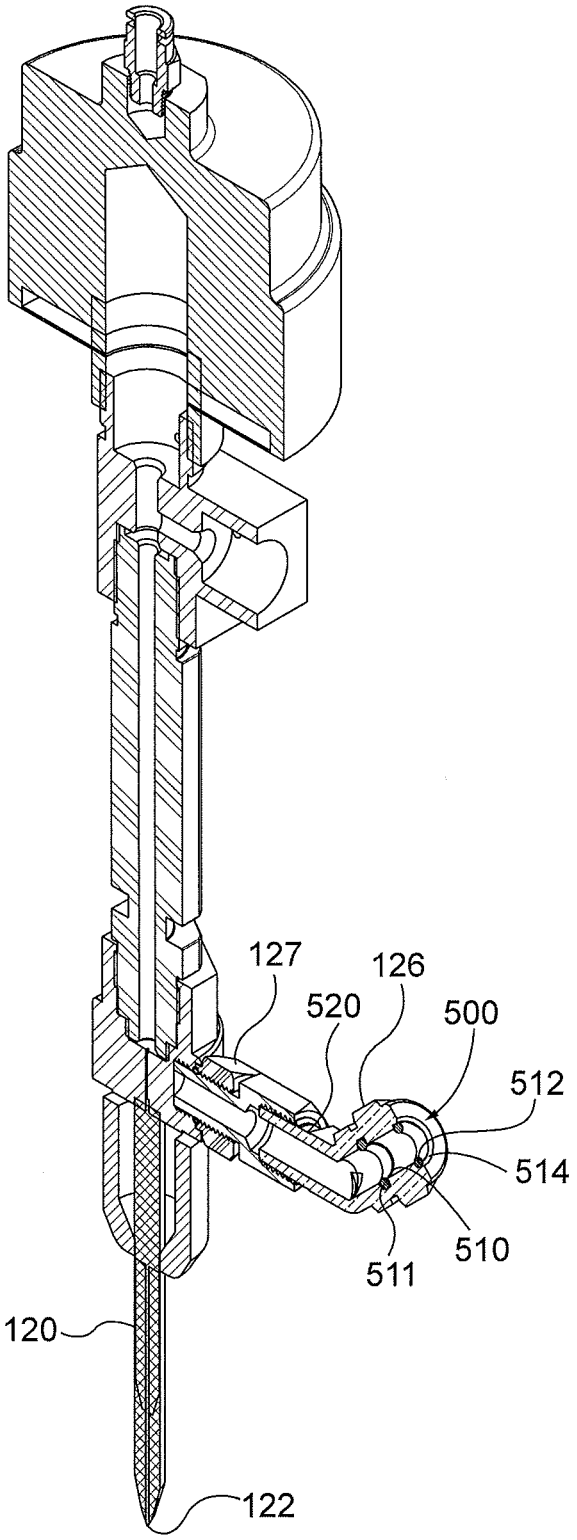
FIG. 10 is a sectional view of a nozzle and abrasive fitting according to principles of the invention.

The stream may include water or other liquid. The waterjet nozzle may supply liquid only or an abrasive may be added to the liquid. Both liquid only and liquid plus abrasive processes may be used in the waterjet system 100 according to the invention. The figures depict a waterjet system 100 that includes an abrasive. In the example, an abrasive supply line 125 (FIG. 4) connects to nozzle 120 to feed abrasive A into the stream of high pressure liquid pumped through nozzle 120. A fitting 126 may extend radially outward from nozzle 120 a distance D above tip 122 to receive abrasive line 125. Since nozzle 120 performs submerged cutting, liquid contacting the abrasive is an issue when such contact may disrupt the flow of abrasive, for example, by causing the abrasive to stick together or clump. As discussed more completely below, to reduce the likelihood of abrasive A entering nozzle 120 from becoming wet, liquid level Lu within cutting tank 140 may be controlled to keep it below fitting 126. As a further precaution, as shown in FIG. 10, fitting may include a sealing assembly, generally indicated at 500 (discussed below) to further reduce the likelihood of the abrasive A being wet from splashing in cutting tank 140 or in instances where it is necessary to submerge the nozzle 120 past fitting 126.

A valve 128 may be located upstream from nozzle within abrasive line 125 to selectively control the amount of abrasive supplied to nozzle 120. It is will be understood that to convert to a liquid only system, the abrasive feed 125 may be turned off at valve 128 in the depicted example, or the abrasive delivery components may be omitted from the system to form a liquid only system.

In general, a waterjet cutting system 100 produces a high pressure stream using a high pressure pump 130, such as a direct drive pump including a crankshaft pump or intensifier pump including a hydraulic pump. The high pressure water is fed to nozzle 120 through jet supply line 135 to produce a cutting stream S (FIGS. 8 and 9), which may also be referred to as a beam. For applications using an abrasive, abrasive A is also supplied to the nozzle 120 to entrain the abrasive A within the stream S before it exits the nozzle 120 such that it too is forced from the nozzle 120 at high pressure. Abrasives may be any solid or semi-solid material. The selection of material often depends on the material being cut and other considerations. In some applications, ice particles are used and offer the advantage of reducing the waste material in the process since the ice melts during the cutting process. In other examples, garnet is used as an abrasive.

Abrasive A may be supplied from an abrasive source such as a hopper 132 or other storage container. In the example shown, hopper 132 is located remotely from the cutting assembly with supply line 125 extending from hopper 132 to a fitting 126 extending from nozzle 120. To help control delivery of abrasive, an abrasive canister 134 may be provided upstream of nozzle 120 and downstream from hopper 132. Canister 134 may be located near to nozzle 120, for example, on the same support used to support nozzle 120, as described more completely below. Canister 134 may be selectively filled from the hopper 132 and then abrasive from canister 134 may be metered out by adjustment of valve 128, which in the example shown, is located downstream of canister 134.

As described more completely during a submerged cutting process, at least the tip of nozzle 120 is submerged within a liquid in a cutting tank, generally indicated by the number 140. Cutting tank 140 may be any container suitable for holding liquid, and generally includes a floor 142 and at least one upstanding wall 144 that define a chamber or cutting volume V that receives the liquid L. Liquid L may be any suitable liquid for use during the cutting process. In the example shown, liquid L is water. As shown, cutting tank 140 may be open at its upward extremity 145 and nozzle 120 supported above cutting tank 140 when not performing submerged cutting. To perform submerged cutting, nozzle 120 may be lowered into cutting tank 140 or cutting tank 140 may be raised so that the upper surface of liquid $L_u$, (FIGS. 8 and 9), also referred to as the liquid level, is above tip 122, as described more completely below.

Cutting tank 140 may be sized to receive a workpiece W. Workpiece W is any material that needs to be cut or shaped by a cutting operation in which at least a portion of the operation is conducted with the tip 122 of nozzle 120 submerged. To that end, at least a portion of workpiece W, where the submerged cutting takes place, is located within cutting tank 140 so that water level $L_u$ may be raised above tip 122. Workpiece W may have any shape or major dimension and cutting tank 140 may be sized to accommodate workpiece W, or cutting tank 140 may be of a general size to receive multiple workpieces of varying size and shape.

Workpiece W may simply rest within cutting tank 140 or it may be suspended within cutting tank 140 on a workpiece support, generally indicated by the number 150. Workpiece support 150 may be a stand, clamp, bracket, or other fixture that holds workpiece W in a selected position. Workpiece support 150 may further include a conveyor or other mechanism that transports the workpiece into and from cutting tank 140 as well. Workpiece support 150 may be supported on an external support i.e. one located outside of tank 140 or an internal support within tank 140. For example, workpiece support 140 may include a stand that is placed on the floor of cutting tank or be a bracket that extends from a wall of cutting tank 140. To that end, workpiece support 150 may be removed from the tank 140 or be fixed to or formed integrally with cutting tank 140 as desired. In the example shown, workpiece support 150 includes a clamp 152 that is supported on a spindle 154 that permits rotation of workpiece W during the cutting operation. It will be understood that other configurations may be used to produce other types of motion for workpiece W including movement along x,y, and z axes or rotation about such axes or another axis defined by workpiece support 150. In the example shown, spindle 154 of workpiece support 150 defines a spindle axis SA parallel to the x-axis of tank 140. Spindle 154 is supported on opposite parallel sidewalls 143 of tank 140. Tank sidewalls 144 may include bearings that allow spindle to rotate, or as shown, a tube 156 may extend through wall 144 of tank and spindle 154 may be rotatably supported on bearings 147 housed within the tube 156. Alternatively, spindle 154 may be supported on bearings located outward of cutting tank 140 and openings may be provided in cutting tank 140 to receive a portion of spindle 154. Since workpiece support 150 may be submersed, bearings and/or the openings in cutting tank 140 would be sealed. In the depicted example that uses hollow tubes 156 to support the spindle 154, the hollow tube 156 is sealed at the wall of tank 140 and another seal 149 is provided about the end of spindle 154 as it protrudes from tube 156.

In the example shown, spindle 154 is supported within an outer tube 156. A spindle position sensor 158 may be provided to monitor the position of spindle 154 and track movement of workpiece W held by clamp 152. Clamp 152 may be any fixture suitable for holding workpiece W in a desired position within cutting tank 140. If a moving clamp 152 is used, as shown, clamp 152 also holds workpiece W as it is moved. Movement of workpiece W may be achieved with a workpiece actuator assembly, generally indicated by the number 160. Workpiece actuator assembly 160 includes any motion control assembly suitable for the desired workpiece motion and may include an arm, linkage, gantry or combinations thereof that are connected to a drive 162, such as a motor drive, pneumatic drive, hydraulic drive and the like or combinations thereof. In the depicted example, workpiece actuator assembly 160 includes spindle 154 and a motor drive 162 that selectively rotates spindle about spindle axis SA. Spindle position sensor 158 and motor drive 162 may be connected to a controller C that receives spindle position feedback from sensor 158 and may provide a signal to motor drive 162 to change spindle position and thereby the workpiece position in an automated fashion. In the example shown, spindle position sensor 158 is an encoder associated with motor drive 162. Controller C may be preprogrammed to perform workpiece movements or provided with instruction to perform a desired movement. Controller C may also include a user input to provide manual control of workpiece movement.

When cutting, the workpiece W moves relative to the nozzle 120. A motion assembly generally indicated by the number 170 creates this relative motion by moving workpiece W, nozzle 120 or a combination thereof. In the example shown, motion assembly 170 provides three axis motion (x, y, and z) by moving nozzle 120. Workpiece actuator assembly 160 may be included within motion assembly 170, and in the example shown provides rotation of workpiece W about axis SA. It will be understood that fewer or greater degrees of freedom may be provided depending on the application. In the example shown, motion assembly 170 includes a gantry 175 that supports a carriage 180 that supports nozzle 120. In the example shown, gantry 175 defines the x axis and carriage 180 is movable along gantry to move nozzle 120 along the x axis.

Gantry 175 is movable along a y axis perpendicular to the x axis to move the nozzle 120 along the y axis and movement of the gantry 175 and carriage 180 may be coordinated to position nozzle 120 within a plane defined by the x and y axes. Motion assembly 170 may further include a nozzle drive 185 (FIG. 4) that moves nozzle vertically along a z axis. In the example shown, nozzle drive 185 is supported on carriage 180 and connected to the cutting head 110 from which nozzle 120 extends. It will be understood that cutting head 110 may be provide with additional degrees of freedom to perform additional local movements of nozzle 120 if desired. Cutting head 110 may be provided with more than one nozzle or additional cutting tools as desired. In the example shown, cutting head 110 includes a drill 115 in addition to nozzle 120. Drill 115 may be used to perform boring operations for a given workpiece W or to facilitate the start of a cut.

Figure 8:
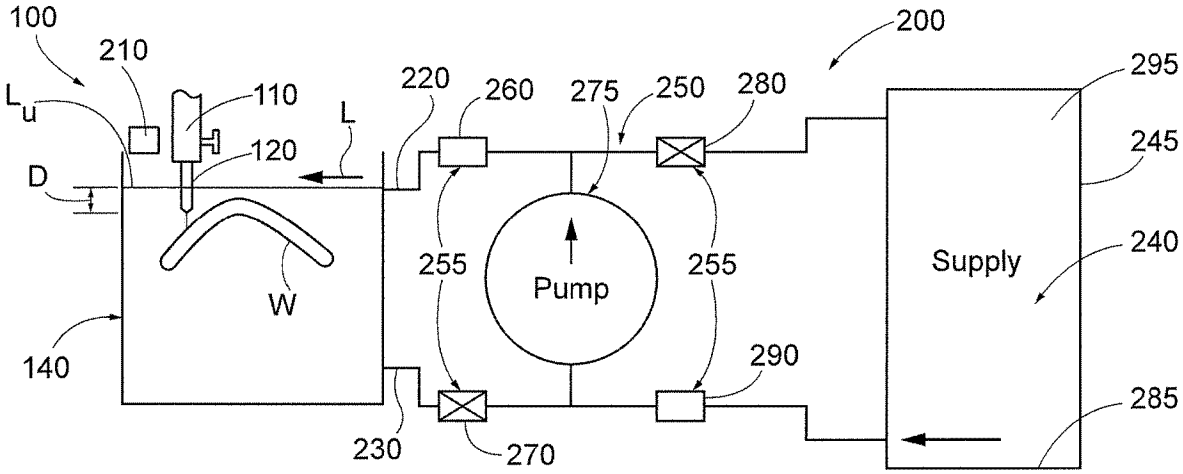
FIG. 8 is a partially schematic view depicting a waterjet system according to principles of the invention with the nozzle in a higher position and a liquid level in a higher position coordinated with the nozzle.
Figure 9:
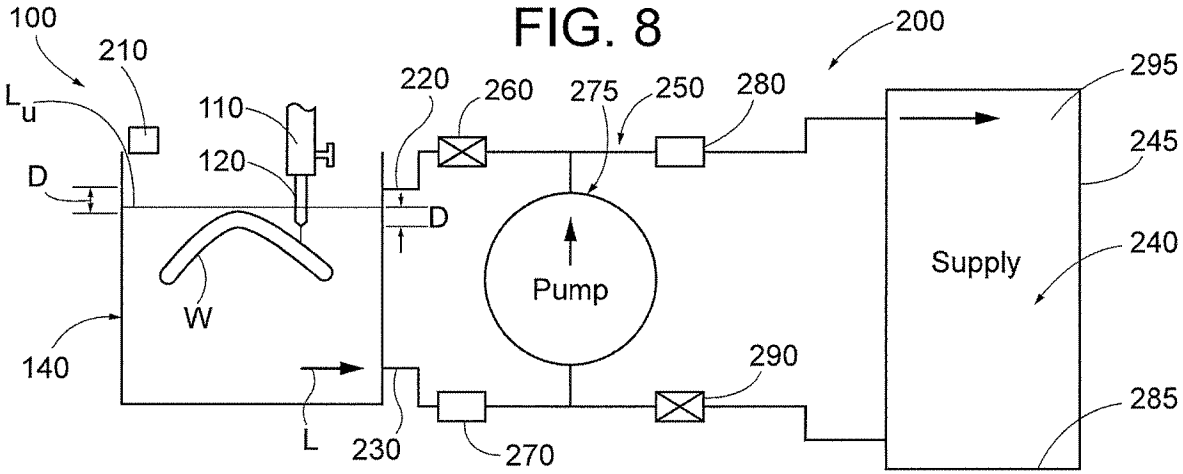
FIG. 9 is a partially schematic view similar to FIG. 8 showing the nozzle in a lower position and the liquid level in a lower position coordinated with the nozzle position.

A liquid level assembly 200 is provided to raise and lower the liquid level $L_u$ in the cutting tank 140. Liquid level assembly 200 may be connected to controller C so that control of the liquid level $L_u$ in cutting tank 140 may be controlled automatically or with manual control via input provided through the controller C. To further improve control, liquid level assembly 200 may include a level sensor 210 that monitors the liquid level $L_u$ in cutting tank 140. Level sensor 210 may be any suitable sensor that detects the height of liquid within cutting tank 140 including but not limited to mechanical sensors, electrical sensors, sonic sensors or light sensors. In the example shown, to reduce the influence of disturbances in cutting tank 140 on the sensed liquid level, sensor 210 includes a wave guide ultrasonic sensor 212 that is located outside of cutting tank 140. Ultrasonic sensor 212 is provided on a snorkel tube 214 that has a lower portion that extends into cutting tank 140 and is vented the extremity of the external portion 216 extending outside of cutting tank 140. Tube 214 acts as a sight glass filling with water to the same level as in cutting tank 140. The sensor 210 obtains a more stable reading as disturbances on the surface of liquid within cutting tank are minimized through the use of the tube 214. Level sensor 210 is connected to controller C to provide feedback as to the liquid level $L_u$ in tank 140. Controller C may use liquid level feedback with nozzle position feedback to coordinate the liquid level $L_u$ in tank 140 with movement of nozzle 120. For example, as depicted in FIGS. 8 and 9, movement of nozzle 120 in the z axis direction i.e. up and down is coordinated with liquid level $L_u$. In particular to maintain, liquid level $L_u$ in a selected position relative to tip 122 of nozzle 120, as nozzle 120 is raised, liquid level $L_u$ is raised. Likewise, as nozzle travels downward, liquid level $L_u$ is lowered to maintain the selected relationship between the liquid level and tip 122 of nozzle 120. For submerged cutting, liquid level $L_u$ is maintained above tip 122. It will be understood that the cutting operation may include both submerged and unsubmerged processes. To that end, the selected level may be below tip 122 if the process is to be unsubmerged. In submerged cutting, to make it less likely that abrasive being fed to nozzle 120 through fitting 126 would be wet by liquid in tank 140, selected level may include a point above tip 122 but below fitting 126. Beyond the cutting operation, controller C may raise or lower liquid level for other purposes. For example, if during a preprogrammed cutting operation, controller C reaches the end of the cutting operation, the liquid level $L_u$ may be lowered below workpiece W or assembly 150 to facilitate removal of workpiece W. Likewise, if an error or other cause to stop cutting operation occurs, controller C may automatically lower liquid level $L_u$ to allow visual observation of workpiece W or a manual input on controller C may be used to lower liquid level $L_u$ for this purpose. Maintaining liquid level $L_u$ at a selected height relative to nozzle 120 may be accomplished by liquid level assembly 200 raising and lowering cutting tank 140 in one example. In this example, a cutting tank actuator would be in communication with a controller C to selectively raise and lower cutting tank with operation of the actuator. Depending on the size of cutting tank 140 and cutting volume, this may not always be practical or desirable.

To that end, liquid level assembly 200 according to another example, increases and decreases the amount of liquid in cutting tank 140 to control liquid level $L_u$. With reference to FIGS. 6-9, liquid level assembly may include an inlet 220 and an outlet 230 to tank 140. Liquid L is provided through inlet 230 from a liquid source or supply generally indicated at 240. Liquid L may be any suitable liquid for performing submerged cutting. In the example shown, liquid L is water. Supply 240 may be a continuous supply such as a pressurized supply line within a building or a discrete source such as a basin, pond, or supply tank 245. Outlet 230 may be connected to supply 240 to form a closed system as depicted in FIGS. 8 and 9 or outlet 230 may drain liquid from cutting tank 140 to another location, such as a remote holding tank or recycling system.

To raise and lower liquid level $L_u$, liquid level assembly 200 includes a valve assembly, generally indicated by the number 250, to control the flow of liquid in and out of cutting tank 240. Valve assembly generally includes at least one valve 255 to control the flow of liquid in and out of tank 140. In the example shown, a first valve 260 is associated with inlet 220 and a second valve 270 is associated with outlet 230 on cutting tank 140. Liquid from supply 240 may be provided to inlet 220 or drained from outlet 230 to change liquid level $L_u$ to the selected level relative to nozzle 120 or other portion of cutting tank 140 as discussed above through valve assembly 250. For example, a first valve 260 fluidly connected to a supply is opened to add liquid through inlet 220 and raise level $L_u$ in cutting tank 140. A second valve 270 associated with outlet 230 may be opened to lower liquid level $L_u$. It will be understood that first and second valves may be held in an open or partially open position to achieve a desired level $L_u$ while circulating liquid through cutting tank 140 or control the rate of change in the liquid level as needed based on the liquid delivery system. For example, when using a pressurized supply, constant or gravity fed supply, the rate that liquid may be added to the cutting tank from supply 240 may be substantially fixed. Likewise, a fixed rate pump may also provide liquid at a fixed rate. Valve assembly 250 may be used to control the rate of change in liquid level $L_u$ in such systems. In the depicted example, liquid level assembly uses a non-pressurized supply in the form of a supply tank 245 and includes a pump assembly 275 to draw liquid from supply tank 245 and deliver it to cutting tank 140. Pump assembly 275 may include a fixed rate pump as discussed or a variable rate pump to control the rate of liquid flow into cutting tank 140 at pump 275.

As mentioned, the depicted example includes a closed liquid level assembly 200, where the inlet 220 and outlet 230 are fluidly connected to supply tank 245. It will be understood that a separate pump may be associated with each of the inlet 220 and outlet 230 to respectively provide fluid from supply tank 245 or draw fluid from cutting tank 140. Alternatively, as shown, a single pump may be used. To accommodate a single pump that operates in only one direction (as shown in FIGS. 8 and 9), valve assembly may include a third valve 280 and a fourth valve 290 that are interposed between pump 275 and supply tank 245. In combination with valves 260, 270, valve assembly 250 forms an H-bridge to selectively control the flow of liquid to and from cutting tank 140 through operation of the unidirectional pump and valves. For example to add liquid to cutting tank 140, second valve 270 and third valve 280 are closed creating a flow path from a base 285 of supply tank 245 to inlet 220 through first valve 260 and fourth valve 280 with the pump 275 located therebetween. In FIG. 9, first valve 260 and fourth valve 280 are closed and second valve 270 and fourth valve 290 are opened to create a flow path between the outlet 230 of cutting tank 140 and an upper portion 295 of supply tank 245 allowing pump 275 to draw liquid from cutting tank 140 and deliver it to supply tank 245.

It may be desirable to remove any cuttings or other particulate within the liquid in cutting tank 140. A filter assembly, generally indicated by the number 300 may be placed in communication with the cutting tank 140 to circulate liquid L from cutting tank 140 therethrough and reduce the amount of particulate, debris, or abrasive within liquid L before returning it to cutting tank 140. In the example shown, filter assembly 300 may draw liquid from cutting tank 140 to an external filter before recirculating the fluid into tank at an inlet 305. Filter assembly 300 may continuously circulate liquid to continuously filter the contents, of cutting tank 140.

In the example shown, filter assembly 300 is provided within cutting tank 140, and may include any suitable filter 310 to reduce the particles, debris, and abrasive within tank. In the example shown, filter 310 within cutting tank 140 is a bulk filter that removes relatively large particles or debris before the liquid L exits cutting tank 140. Plural filters 310 may be provided in cutting tank 140 and associated with plural drains 315 to disperse the removal of liquid from cutting tank 140 over a larger area. In the example shown, drains 315 are generally positioned near the perimeter 320 of cutting tank 140 in a substantially square pattern. Conical filters 310 extend upward from drains 315. Spreading the removal of liquid from cutting tank 140 over a larger area or using multiple drains is optionally employed to reduce the creation of any strong currents within cutting tank 140 that would stir up particles, debris or abrasive in cutting tank 140 in a manner that would interfere with cutting. Filter assembly 300 may include additional filters to remove finer particles that pass first filter 310. For example filter assembly 300 may include an abrasive recover assembly, generally indicated at 400 in FIG. 1. Liquid from cutting tank 140 may be routed from drains 315 to recovery assembly and passed through an abrasive screen 410 or other suitable filter, which may be configured as a screening bag or other container that gathers abrasive carried in the outlet liquid. Liquid passing through screen 410 falls into a recovery tank 420 that has a depth sufficient to prevent the liquid in the tank 420 from contacting screen 410. The screened liquid may be routed from recovery assembly 400 back to cutting tank 140 in a closed recirculating system. Alternatively, clean liquid from a liquid supply may be provided to cutting tank 140 to maintain liquid level Lu while liquid is removed for filtration. A separate liquid supply may be used for this purpose, or, as discussed above, liquid level assembly 200 may provide liquid L to cutting tank to maintain liquid level $L_u$.

To further reduce disturbances within cutting tank 140, liquid level assembly 200 may include an inlet 220 that has a larger opening 225 than the opening within the inlet line 330. The inlet line 330 and inlet 220 may be connected by an outwardly expanding transition 335 that acts to decelerate liquid from pump 275 as it enters cutting tank 140. As a further alternative, a baffle 340 may be provided within cutting tank 140 within the flow path of inlet 220. Baffle 340 may be any structure that disperses or redirects the flow of liquid entering cutting tank 140 from inlet 220 to reduce currents that might interfere with the cutting operation. Suitable baffles might include screens, tubes, or other objects that have openings therebetween that are placed in the flow path of liquid exiting inlet such that the liquid is decelerated as it moves around these objects and through openings. These objects may also be used to direct the flow path away from nozzle 120. In the example shown, baffle 340 includes a baffle plate 345 that rests on an upper portion of inlet 220 and extends downward and outward from inlet 220 to channel the flow F from inlet 220 toward the floor 142 of cutting tank 140 while further decelerating the flow F. Optionally, baffle plate 345 may have sidewalls 355 that extend toward sidewall of tank 140 to form a duct around inlet 220.

With reference to FIG. 10, fitting 126 may be provided with a sealing assembly 500 to reduce the likelihood of abrasive fed through fitting 126 into nozzle 120 from becoming wet. As mentioned, wet adhesive tends to clump and not feed accurately into nozzle 120 and in some situations may clog nozzle or interrupt the cutting stream S. As shown, fitting 126 may thread onto a coupling 127 extending outward from nozzle 120. Fitting 126 may define a receiver 510 to receive a first seal 511, such as an o-ring or the like to engage the abrasive supply line as it is inserted within fitting 126. A second seal 512 may be provided at the outer extremity of fitting 126 to provide an additional seal against abrasive supply line. As show, second seal 512 may reside in a second receiver 514 located just inward of the opening. To seal the fitting 126 to coupler 127, an additional seal may be provided at the outer extremity 520 of coupler 127 as well.

It will be understood that the various optional features and components described herein may be interchanged and combined, as illustrated in the examples below.

EXAMPLES

Example 1

A waterjet system comprising a nozzle supported within a cutting tank, the cutting tank having a floor and at least one upstanding wall defining a cutting volume, wherein the cutting volume is at least partially filled with a liquid, and wherein the nozzle is submersible within the liquid to perform a submerged cutting operation; a high pressure fluid supply selectively fluidly connected to the nozzle to produce a cutting stream; a controller; a level sensor in sensing communication with the liquid in the cutting tank to measure a liquid level within the cutting tank, the level sensor being in communication with the controller to provide the liquid level to the controller; a liquid level assembly in communication with the controller and adapted to maintain a selected liquid level within the cutting tank.

Example 2

The waterjet system of example 1 where the nozzle includes a tip at its outer extremity, the tip having an opening where liquid exits the nozzle, wherein the selected liquid level is measured relative to the tip of the nozzle such that the height of the liquid in the cutting tank is maintained at a selected height above the tip of the nozzle during the cutting operation.

Example 3

The waterjet system of example 2 further including an abrasive supply line attached to the nozzle above the tip, wherein the selected height above the tip is below the abrasive supply line.

Example 4

The waterjet system of example 1, wherein the nozzle is supported on a cutting head, wherein at least one motor is connected to the nozzle to selectively change a nozzle height, the motor including an encoder that provides the nozzle height to the controller.

Example 5

The waterjet system of example 4, where the controller determines a position of a tip of the nozzle as the nozzle height changes and selectively operates the liquid level assembly to maintain the liquid level above the tip of the nozzle during the submerged cutting operation.

Example 6

The waterjet system of example 5, where the nozzle includes an abrasive supply line entering the nozzle above the tip, where the controller maintains the liquid level below the abrasive supply line.

Example 7

The waterjet system of example 1, wherein the liquid level assembly includes a pump and a valve assembly in communication with the cutting tank and a liquid supply to selectively add or remove liquid to maintain the selected liquid level.

Example 8

The waterjet system of example 7, where the pump and valve assembly including a first, second, third, and fourth valve arranged in an h-bridge with a first valve pair on one side of the pump and a second valve pair on the second side of the pump, wherein the first and second valves are in the first valve pair and the third and fourth valves are in the second valve pair, wherein the first valve pair connects to the cutting tank and the second valve pair connect to a liquid supply, wherein closing the first and fourth valves cause the pump to remove liquid from the cutting tank, and wherein closing the second and third valves causes the pump to add liquid to the cutting tank.

Example 9

The waterjet system of example 1, wherein the liquid level assembly includes an inlet formed in the cutting tank, the inlet defining a flow path, wherein the liquid level assembly includes a baffle located in the flow path of the inlet.

Example 10

The waterjet system of example 9, wherein the baffle includes a baffle plate that extends downward and inward relative to the flow path of the inlet.

Example 11

The waterjet system of example 10, wherein the baffle plate has a constant slope as it extends downward and inward from the inlet.

Example 12

The waterjet system of example 11, wherein the baffle plate contacts an upper portion of the inlet.

Example 13

The waterjet system of example 9, wherein the baffle further comprises at least one sidewall extending from the baffle plate toward the wall of the cutting tank.

Example 14

The waterjet system of example 1 where the liquid in the cutting tank is water.

Example 15

The waterjet system wherein the liquid level assembly includes an outlet in the cutting tank, wherein the outlet is selectively opened to lower the liquid level within the cutting tank.

Example 16

The waterjet system of example 1 further comprising a filter assembly in communication with the cutting tank.

Example 17

The waterjet system of example 16, wherein the filter assembly includes plural drains within the cutting volume spaced from each other toward a perimeter of the cutting tank, wherein each drain includes a bulk filter upstream thereof, and wherein the filter assembly includes an abrasive recovery assembly downstream of the plural drains, wherein the abrasive recovery assembly screens abrasive from the liquid drained from the cutting tank before returning the liquid to the cutting tank.

Example 18

The waterjet system of example 1 further comprising a workpiece support within the cutting tank, wherein the workpiece support is connected to a motion assembly to selectively move the workpiece support.

Example 19

The waterjet system of example 18, wherein the motion assembly includes a spindle that is rotatably mounted within the cutting tank and a motor adapted to rotate the spindle, and wherein the workpiece support is supported on the spindle.

Example 20

The waterjet system of example 18, wherein the motion assembly is connected to the controller and includes a motion sensor that communicates a position of the workpiece to the controller.

While the disclosure has been described in terms of exemplary aspects, those skilled in the art will recognize that the disclosure can be practiced with modifications in the spirit and scope of the appended claims. These examples given above are merely illustrative and are not meant to be an exhaustive list of all possible designs, aspects, applications or modifications of the disclosure.

What is claimed is:

1. A waterjet system comprising a nozzle supported within a cutting tank, the cutting tank having a floor and at least one upstanding wall defining a cutting volume, wherein the cutting volume is at least partially filled with a liquid, and wherein the nozzle is submersible within the liquid to perform a submerged cutting operation;

a high pressure fluid supply selectively fluidly connected to the nozzle to produce a cutting stream;

a controller;

a level sensor in sensing communication with the liquid in the cutting tank to measure a liquid level within the cutting tank, the level sensor being in communication with the controller to provide the liquid level to the controller; and a liquid level assembly in communication with the controller and adapted to maintain a selected liquid level within the cutting tank relative to the nozzle, wherein the nozzle is supported on a cutting head, wherein at least one motor is connected to the nozzle to selectively change a nozzle height, the motor including an encoder that provides the nozzle height to the controller, and wherein the controller determines a position of a tip of the nozzle as the nozzle height changes and selectively operates the liquid level assembly to maintain the liquid level above the tip of the nozzle during the submerged cutting operation.

2. The waterjet system of claim 1 where the nozzle includes the tip at an outer extremity thereof, the tip having an opening where liquid exits the nozzle, wherein the selected liquid level is measured relative to the tip of the nozzle such that the height of the liquid in the cutting tank is maintained at a selected height above the tip of the nozzle during the cutting operation.

3. The waterjet system of claim 2 further including an abrasive supply line attached to the nozzle above the tip, wherein the selected height above the tip is below the abrasive supply line.

4. The waterjet system of claim 1, where the nozzle includes an abrasive supply line entering the nozzle above the tip, where the controller maintains the liquid level below the abrasive supply line.

5. The waterjet system of claim 1, wherein the liquid level assembly includes a valve assembly in communication with the cutting tank and a liquid supply to selectively add or remove liquid to maintain the selected liquid level.

6. The waterjet system of claim 5, where the liquid level assembly includes a pump in communication with the valve assembly, and the valve assembly includes a first, second, third, and fourth valve arranged in an h-bridge with a first valve pair on one side of the pump and a second valve pair on a second side of the pump, wherein the first and second valves are in the first valve pair and the third and fourth valves are in the second valve pair, wherein the first valve pair connects to the cutting tank and the second valve pair connects to a liquid supply, wherein closing the first and fourth valves causes the pump to remove liquid from the cutting tank, and wherein closing the second and third valves causes the pump to add liquid to the cutting tank.

7. The waterjet system of claim 1 where the liquid in the cutting tank is water.

8. The waterjet system of claim 1 wherein the liquid level assembly includes an outlet in the cutting tank, wherein the outlet is selectively opened to lower the liquid level within the cutting tank.

9. The waterjet system of claim 1 further comprising a filter assembly in fluid communication with the cutting tank.

10. The waterjet system of claim 9, wherein the filter assembly includes plural drains within the cutting volume spaced from each other toward a perimeter of the cutting tank, wherein each drain includes a bulk filter upstream thereof, and wherein the filter assembly includes an abrasive recovery assembly downstream of the plural drains, wherein the abrasive recovery assembly screens abrasive from the liquid drained from the cutting tank before returning the liquid to the cutting tank.

11. The waterjet system of claim 1 further comprising a workpiece support within the cutting tank, wherein the workpiece support is connected to a motion assembly to selectively move the workpiece support.

12. The waterjet system of claim 11, wherein the motion assembly includes a spindle that is rotatably mounted within the cutting tank and a motor adapted to rotate the spindle, and wherein the workpiece support is supported on the spindle.

13. The waterjet system of claim 11, wherein the motion assembly is connected to the controller and includes a motion sensor that communicates a position of a workpiece to the controller.

14. A waterjet system comprising a nozzle supported within a cutting tank, the cutting tank having a floor and at least one upstanding wall defining a cutting volume, wherein the cutting volume is at least partially filled with a liquid, and wherein the nozzle is submersible within the liquid to perform a submerged cutting operation;

a high pressure fluid supply selectively fluidly connected to the nozzle to produce a cutting stream;

a controller;

a level sensor in sensing communication with the liquid in the cutting tank to measure a liquid level within the cutting tank, the level sensor being in communication with the controller to provide the liquid level to the controller; and a liquid level assembly in communication with the controller and adapted to maintain a selected liquid level within the cutting tank relative to the nozzle, wherein the liquid level assembly includes an inlet formed in the cutting tank, the inlet defining a flow path, wherein the liquid level assembly includes a baffle located in the flow path of the inlet.

15. The waterjet system of claim 14, wherein the baffle includes a baffle plate that extends downward and inward relative to the flow path of the inlet.

16. The waterjet system of claim 15, wherein the baffle plate has a constant slope as it extends downward and inward from the inlet.

17. The waterjet system of claim 15, wherein the baffle plate contacts an upper portion of the inlet.

18. The waterjet system of claim 15, wherein the baffle further comprises at least one sidewall extending from the baffle plate toward the wall of the cutting tank.

* * * * *